US007347291B2

(12) United States Patent
Mattila

(10) Patent No.: US 7,347,291 B2
(45) Date of Patent: Mar. 25, 2008

(54) BIT ASSEMBLY

(75) Inventor: Mikko Mattila, Tampere (FI)

(73) Assignee: Robit Rocktools Ltd, Lempaala (FI)

( * ) Notice: Subject to any disclaimer, the term of this patent is extended or adjusted under 35 U.S.C. 154(b) by 213 days.

(21) Appl. No.: 10/540,248

(22) PCT Filed: Dec. 23, 2003

(86) PCT No.: PCT/FI03/00982

§ 371 (c)(1),
(2), (4) Date: Jun. 22, 2005

(87) PCT Pub. No.: WO2004/057148

PCT Pub. Date: Jul. 8, 2004

(65) Prior Publication Data

US 2006/0081403 A1 Apr. 20, 2006

(30) Foreign Application Priority Data

Dec. 23, 2002 (FI) ..... 20022276

(51) Int. Cl.
*E21B 10/26* (2006.01)

(52) U.S. Cl. ..... 175/385; 175/407

(58) Field of Classification Search ..... 175/385, 175/386, 407, 415

See application file for complete search history.

(56) References Cited

U.S. PATENT DOCUMENTS 3,277,230 A 10/1966 Stickney et al.
5,284,216 A * 2/1994 Brungs et al. ..... 175/385
5,590,726 A 1/1997 Jarvela et al.
5,839,519 A 11/1998 Spedale, Jr.
5,957,224 A 9/1999 Ilomaki

FOREIGN PATENT DOCUMENTS

DE 42 25 701 C1 8/1992
WO WO 98/13575 4/1998

* cited by examiner

*Primary Examiner*—William P Neuder
(74) *Attorney, Agent, or Firm*—Stites & Harbison PLLC; Douglass E. Jackson

(57) ABSTRACT

A bit assembly for a drilling apparatus working by impact and rotation or merely by rotation, and comprising a pilot bit (1) drilling the hole centre and in connection with the pilot bit a ring bit (2) is arranged to drill the outer circle of the hole and, further, between pilot bit and ring bit surfaces are arranged to transmit impacts and/or rotary motion from the pilot bit to the ring bit, and the bit assembly also including an arrangement for pulling protection tube into the hole on drilling. In the bit assembly between ring bit (2) and pilot bit (1) at least an arrangement transmitting rotation is jointly fitted in the ring bit shirt portion (5) by forming the rear edge of the shirt portion seen in the drilling direction to comprise surfaces with different directions, which with one of their portion (4) can transmit rotary motion force to the ring bit (2) and with their adjacent part (3) force to pull said ring bit off the hole.

5 Claims, 2 Drawing Sheets

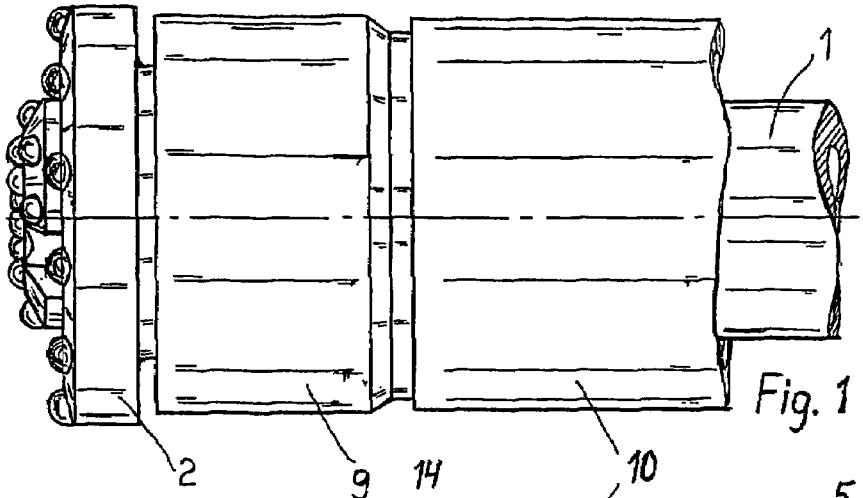
Fig. 1
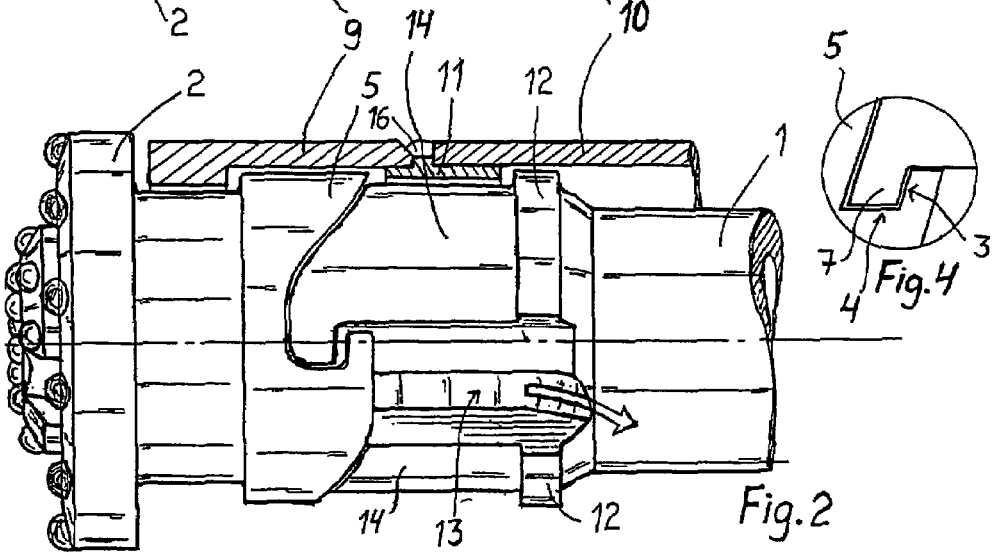
Fig. 4
Fig. 2
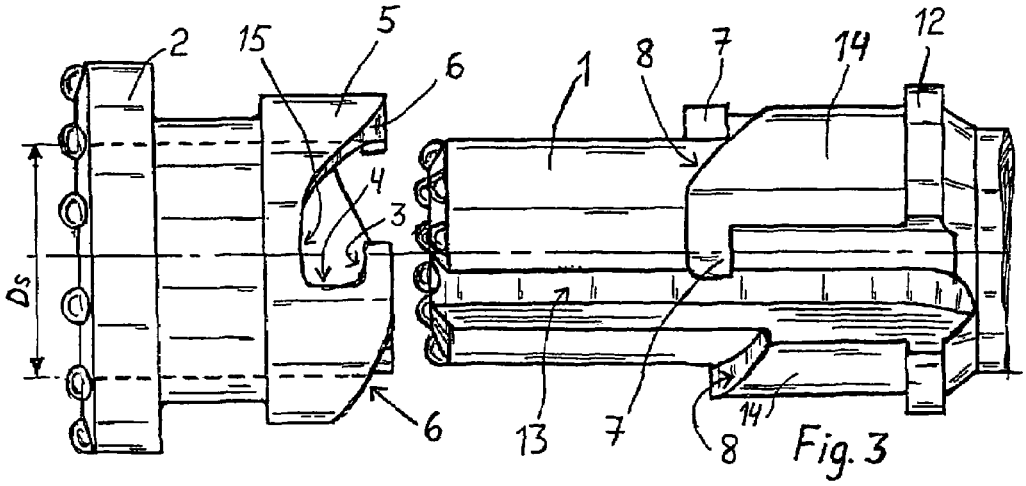
Fig. 3

BIT ASSEMBLY

The invention relates to a bit assembly intended for a drilling apparatus working by impact and rotation or merely by rotation and comprising a pilot bit drilling the hole centre and in connection with the pilot bit a ring bit is arranged to drill the outer circle and, further, between pilot bit and ring bit surfaces are arranged to transmit impacts and/or rotary motion from the pilot bit to the ring bit, and the bit assembly comprising also an assembly t pull the protecting tube into the hole on drilling.

Previously known is among other things from GB patent specification 959955 a drilling apparatus like the above presented one having a centre bit and a ring bit, where the ring bit is introduced to be lockable to the middle bit by means of bayonet joint. In the inner surface of the ring bit longitudinal grooves have been made, and furthermore, transverse grooves ending on a certain spot, whereby in mounting the ring bit to the middle bit the brackets of the middle bit run at first along the longitudinal grooves and, finally, rotating the bits among themselves the brackets run to the ends of the crosswise grooves. The longitudinal grooves work at the same time as a passage for flushing medium.

From the later Finnish patent specification FI-96518 a similar bayonet locking between bits is known and even in this embodiment the groove of the longitudinal bayonet locking works as a flushing channel.

The disadvantage of this kind of bayonet locking is that into the inner surface of the ring bit grooves must be worked in two separate directions or, alternatively, the inner surface must be so worked that there must remain brackets directed towards the ring bit centre. It is not possible to make the ring bit inner surface a straight cylindrical surface. Furthermore, in connection with the above presented solution there has been difficulties appearing in the middle of drilling on getting the middle bit back into the hole with the ring bit for locking. In these cases of re-fitting it is quite impossible to discover, when in the bayonet locking the longitudinal motion has taken place and when it is the proper moment to rotate the middle bit so that locking would get all the way. This is difficult in a long drill hole and often drilling is started in a situation, where the bayonet locking is not yet quite completed.

In order to eliminate the above disadvantages between ring bit and middle bit a new embodiment is developed characterized in that in the bit assembly the rotation-blocking arrangement and axial motion between ring bit and pilot bit is fitted in the shirt portion of the ring bit rear edge so that the said arrangement is located in a diameter portion greater than diameter Ds of the inner surface, which is free of grooves, on the shirt part of which portion the locking nose fitted in the pilot bit is applicable to the shirt portion having the shape of a counter gap fitted for the nose and reaching through the shirt wall and which gap shape has surfaces capable to one part to transmit rotary motion power to the ring bit and with its adjacent part power for pulling the ring bit off the hole.

The advantage of the bit assembly as per the invention is that the machinings of the ring bit or correspondingly of the middle bit, in other words the pilot bit, are easy jobs, since in this case, for instance, the inner surface of the ring bit is a cylinder surface without grooves or brackets. In the outer surface of the pilot ring grooves and shapes must be done, but in the outer surface of such a piece they are easily done. In the ring bit shirt portion shapes must be done, but to their character these machinings are quite usual machine technique. The pilot bit can be pulled off the hole in the middle of drilling and re-installed. In the embodiment as per the invention it surely will be directed to its place in regard to the ring bit merely rotating it in the right direction. Also pushing the pilot bit axially towards the ring bit and into it steers the said parts into mutual locking state, when percussion-transmitting counter surfaces are made slanting. By means of the pilot bit the ring bit and the protecting tube can be pulled off the hole, for instance simultaneously rotating the pilot bit in locking direction.

In the following the invention is disclosed with reference to the enclosed drawing, where FIG. 1 shows the pointed end of the drilling apparatus from the side.

FIG. 2 shows the pointed end of the drilling apparatus and the a sectional view of the protecting tube and the drill shoe FIG. 3 shows the drilling apparatus with loose ring bit and loose pilot bit.

FIG. 4 shows an alternative way of locking.

Figure 5:
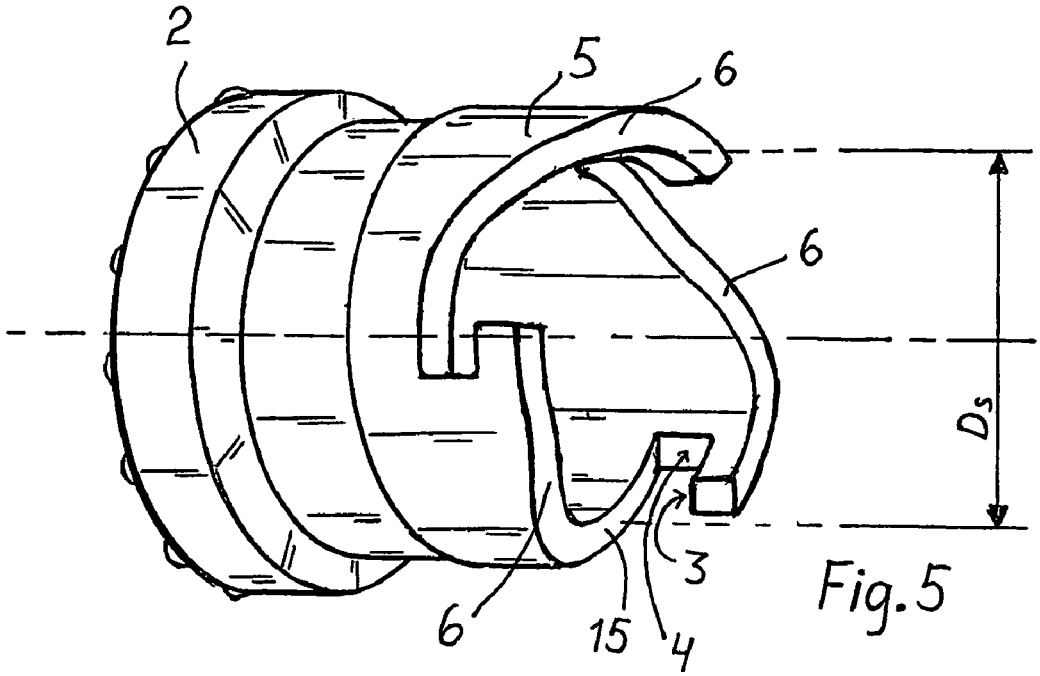
FIG. 5 shows the ring bit diagonally.

FIG. 1 shows a drilling apparatus comprising a pilot bit, with other words a middle bit 1 and a ring bit 2 and the farthest drill shoe 9 and protecting tube 10.

FIG. 2 shows the construction more accurately, whereby in the shirt portion 5 to the inner surface cylindrical ring bit shapes have been machined, among other things a pitch angle shape 6 and a gap shape 3, 4. Pilot bit 1, partly inside ring bit 2, comprises a diameter change behind shirt part 5 of ring bit 2, i.e. portion 14, by means of which the outer diameter is increased. In the front edge of this portion 14 a counter shape 7 fitted to the shapes of shirt 5 of ring bit 2 is formed. One pull-off solution of protecting tube 10, illustrated by drill shoe 9, protecting tube 10, middle bit 11, weld 16 and percussion shoulder 12 of pilot bit 1, is also shown in FIG. 2 sectional view.

A channel 13 is arranged to let out drill waste by means of flushing medium from the front of the bits. The channel is a longitudinal groove on the pilot bit 1 surface. On the inner surface of ring bit 2 there is neither a groove nor a shape connected to the function of flushing channel 13.

Separately in FIG. 3 ring bit 2 is shown, which has an inner diameter Ds. The inner surface is a smooth rotary cut cylindrical surface. In the shirt portion 5 of ring bit 2 there are between bits 1 and 2 three units carrying out locking. The unit includes the pitch angle shaped portion 6 and, most suitably, the gap like portion with counter surface 4 at least for rotary power and a counter surface for tractive force, which is meant to pull the ring bit backward, that is out off hole. The pitch angle shaped portion 6 is also meant to transmit percussions or force in the drilling direction. Ring bit 1 transmits rotary power to ring bit 2. In one embodiment percussions are conducted to bit 1, whereby the percussions are transmitted to ring bit 2 over surface 6. The percussion-transmitting can be all the way pitch angel shaped, in other words slanting. Pushing the pilot bit 1 into ring bit 2 forces the bits into mutual locking state. Then as extension of pitch angle shaped surface 6 can also be a not pitch angle shaped portion 15. While pitch angle shaped surface 6 is transmitting percussions the transmission of percussion into ring bit 2 causes rotary motion exactly in the right direction in other words keeps the bits interlocked.

Correspondingly, pilot bit 1 has a pitch angle shaped portion 8 and a nose 7 fitting into gap 3, 4 merely by means of pilot bit rotation. In horizontal drilling position by re-installation of pilot bit 1 the pilot bit must be pushed a little by means of the drill rod. In vertical drilling position pilot bit 1 and the drill rods facilitate by their own weight the pilot bit 1 to interlocking with ring bit 2. Even though bit ring 2 could turn simultaneously a little, when pilot bit 1 is being re-installed into the hole, the installation works however unavoidably at once as well as detachment.

In known bayonet locking embodiments the simultaneous turning of ring bit with the rotation may prevent locking and, correspondingly, a successful detachment.

From pilot bit 1 the all the percussions to ring bit 2 are conducted to the rear edge of the shirt of ring bit 2, whereby the bit like rear surface can be used.

The gap shape 3, 4, 15 can be circular or formed of bent parts, whereby the nose is also circular or similar. The gap shape 3, 4, 15 can be angular including straight portions, correspondingly the nose is also angular. FIG. 4 shows a gap formation and a nose solution, where the axial play of nose 7 can be made quite small. In this case also the whole rear edge of ring bit 2 is slanting, with other words pitch angle shaped. Flushing channel 13 is located fully independent from closing elements 3, 4, 7, since, on the whole, the closing elements are located farther from the centre line of the apparatus than flushing groove 13.

FIG. 5 is a diagonal view of ring bit 2, where the smooth cylindrical surface is visible, which works as an inner surface, and the gap shapes made in shirt portion 5 have percussion-transmitting surfaces 3, 4, 15 and 16.

The invention claimed is:

1. A bit assembly for a drilling apparatus working by impact and rotation or merely by rotation, and comprising a pilot bit which drills a center portion of a hole, a ring bit in connection with the pilot bit which said ring bit is arranged to drill an outer circle portion of the hole, surfaces, between the pilot bit and the ring bit, which are arranged to transmit impacts and/or rotary motion from the pilot bit to the ring bit, a pulling arrangement which pulls a protecting tube into the hole on drilling, a blocking arrangement which blocks rotation and axial motion between the pilot bit and the ring bit, said blocking arrangement being jointly fitted in a rear edge of a shirt portion of the ring bit so that the blocking arrangement is located on a diameter portion greater than a diameter of a groove-free inner surface of the ring bit, a locking nose of the pilot bit which can be fitted to the shirt portion, the shirt portion having a counter-groove shape for fitting the locking nose which reaches through the shirt, which counter-groove shape comprises a first surfaces that can transmit rotary motion force to the ring bit and a second surface that can transmit a force to pull the ring bit off the hole.

2. A bit assembly according to claim 1, wherein the pilot bit comprises on a portion thereof a diameter change, which is located behind the ring bit as viewed from the drilling direction, and wherein a front edge of said diameter change portion comprises the locking nose which is fitted to work co-operatively with the first and second surfaces.

3. A bit assembly according to claim 1, wherein the counter-groove shape of the shirt portion comprises a pitch angle shaped portion and a closing portion that forms a closing groove for connecting the pilot bit to the ring.

4. A bit assembly according to claim 1, wherein the rear edge of the shirt portion comprises at least a pitch angle shaped portion and at least one no pitch angle shaped portion, and wherein said shaped portions are arranged as the only surfaces to take percussions from the pilot bit.

5. A bit assembly according to claim 3, wherein the shirt portion includes a plurality of pitch angle shaped portions and associated grooves.

* * * * *